US010568377B2

(12) United States Patent
Sicking

(10) Patent No.: US 10,568,377 B2
(45) Date of Patent: Feb. 25, 2020

(54) PROTECTIVE HELMET SYSTEMS THAT ENABLE THE HELMET TO ROTATE INDEPENDENT OF THE HEAD

(71) Applicant: THE UAB RESEARCH FOUNDATION, Birmingham, AL (US)

(72) Inventor: Dean Sicking, Indian Springs Village, AL (US)

(73) Assignee: The UAB REASEARCH FOUNDATION INC., Birmingham, AL (US)

( * ) Notice: Subject to any disclaimer, the term of this patent is extended or adjusted under 35 U.S.C. 154(b) by 118 days.

(21) Appl. No.: 15/541,719

(22) PCT Filed: Jan. 7, 2016

(86) PCT No.: PCT/US2016/012544
§ 371 (c)(1),
(2) Date: Jul. 6, 2017

(87) PCT Pub. No.: WO2016/112225
PCT Pub. Date: Jul. 14, 2016

(65) Prior Publication Data

US 2018/0220730 A1 Aug. 9, 2018

Related U.S. Application Data

(60) Provisional application No. 62/100,751, filed on Jan. 7, 2015.

(51) Int. Cl.
*A42B 3/08* (2006.01)
*A42B 3/06* (2006.01)

(52) U.S. Cl.
CPC ..... *A42B 3/08* (2013.01); *A42B 3/063* (2013.01); *A63B 2243/007* (2013.01)

(58) Field of Classification Search
CPC ..... A42B 3/08; A42B 3/04
USPC ..... 2/421
See application file for complete search history.

(56) References Cited

U.S. PATENT DOCUMENTS 3,600,714 A 8/1971 Cade et al.
3,818,509 A 6/1974 Romo et al.
3,916,446 A * 11/1975 Gooding ..... A42B 3/08 2/421
4,051,556 A 10/1977 Davenport et al.
4,646,368 A 3/1987 Infusino et al.
(Continued)

FOREIGN PATENT DOCUMENTS

DE 8601332 U1 6/1986

OTHER PUBLICATIONS

International Search Report for PCT/US2016/012544 dated Jun. 10, 2016.

(Continued)

*Primary Examiner* — Tajash D Patel
(74) *Attorney, Agent, or Firm* — Thomas Horstemeyer, LLP; Christopher B. Linder; Jason M. Perilla

(57) ABSTRACT

A protective helmet includes an outer shell, an inner liner provided within the shell, a chinstrap coupled to the shell including a chin cup adapted to contact and protect the wearer's chin, and decoupling means that decouple the shell from the chin cup to enable the shell to rotate relative to the head when the helmet is worn and the chinstrap is securely fastened about the chin.

29 Claims, 7 Drawing Sheets

(56) References Cited

U.S. PATENT DOCUMENTS

| | | | | |
|---|---|---|---|---|
| 5,027,479 | A | 7/1991 | Scheffczyk | |
| 5,259,096 | A | 11/1993 | Grant | |
| 5,347,660 | A | 9/1994 | Zide et al. | |
| 5,685,020 | A | 11/1997 | Powell et al. | |
| 6,029,962 | A | 2/2000 | Shorten et al. | |
| 6,081,932 | A * | 7/2000 | Kraemer | A42B 3/08 2/421 |
| 6,298,483 | B1 | 10/2001 | Schiebl et al. | |
| 6,481,024 | B1 * | 11/2002 | Grant | A42B 3/08 2/421 |
| 7,849,525 | B2 | 12/2010 | Ghajar | |
| 7,921,475 | B2 | 4/2011 | Nascimento et al. | |
| 8,069,498 | B2 | 12/2011 | Maddux et al. | |
| 8,387,164 | B2 | 3/2013 | Maddux et al. | |
| 8,621,671 | B1 * | 1/2014 | Schiebl | A42B 3/205 2/421 |
| 2001/0002087 | A1 | 5/2001 | Townsend | |
| 2006/0059606 | A1 | 3/2006 | Ferrara | |
| 2006/0179537 | A1 * | 8/2006 | Dennis | A42B 3/08 2/6.6 |
| 2009/0265841 | A1 | 10/2009 | Ferrara | |
| 2010/0319109 | A1 | 12/2010 | Field | |
| 2011/0277225 | A1 | 11/2011 | Salkind et al. | |
| 2013/0185837 | A1 | 7/2013 | Phipps et al. | |
| 2014/0007322 | A1 | 1/2014 | Marz et al. | |
| 2014/0053324 | A1 | 2/2014 | Jackson | |
| 2014/0310856 | A1 | 10/2014 | Guadagnin et al. | |

OTHER PUBLICATIONS

NOCSAE. Standard Performance Specification for Newly Manufactured Football Helmets. National Operating Committee on Standards for Athletic Equipment: NOCSAE Doc (ND)002-13m13, 2013.

PCT Patent Application PCT/US2015/060225 filed on Nov. 11, 2015, International Search Report and Written Opinon dated Feb. 3, 2016.

PCT Patent Application PCT/US2015/060226 filed on Nov. 11, 2015, International Search Report and Written Opinon dated Jan. 13, 2016.

PCT Patent Application PCT/US2015/060227 filed on Nov. 11, 2015, International Search Report and Written Opinion dated Jan. 13, 2016.

Rowson, S. and Duma, S. M., (2011). Development of the STAR Evaluation System for Football Helmets: Integrating Player Head Impact Exposure and Risk of Concussion. Annals of biomedical engineering, 39(8), 2130-2140.

Rowson, S., Duma, S. M., Beckwith, J. G., Chu, J. J., Greenwald, R. M., Crisco, J. J., . . . & Maerlender, A. C. (2012). Rotational head kinematics in football impacts: an injury risk function for concussion. Annals of biomedical engineering, 40(1), 1-13.

United States. Department of Defense. Technology Readiness Assessment (TRA) Guidance. Revised. May 2011.

* cited by examiner

PROTECTIVE HELMET SYSTEMS THAT ENABLE THE HELMET TO ROTATE INDEPENDENT OF THE HEAD

CROSS-REFERENCE TO RELATED APPLICATION

This application is the 35 U.S.C. § 371 national stage application of PCT Application No. PCT/US2016/012544, filed Jan. 7, 2015, where the PCT claims priority to U.S. Provisional Application Ser. No. 62/100,751, filed Jan. 7, 2015, both of which are herein incorporated by reference in their entireties.

BACKGROUND

Sports concussion and traumatic brain injury have become important issues in both the athletic and medical communities. As an example, in recent years there has been much attention focused on the mild traumatic brain injuries (concussions) sustained by professional and amateur football players, as well as the long-term effects of such injuries. It is currently believed that repeated brain injuries such as concussions may lead to diseases later in life, such as depression, chronic traumatic encephalophathy (CTE), and amyotrophic lateral sclerosis (ALS).

Protective headgear, such as helmets, is used in many sports to reduce the likelihood of brain injury. Current helmet certification standards are based on testing parameters that were developed in the 1960s, which focus on the attenuation of linear impact and prevention of skull fracture. An example of a linear impact is a football player taking a direct hit to his helmet from a direction normal to the center of his helmet or head. Although the focus of headgear design has always been on attenuating such linear impacts, multiple lines of research in both animal models and biomechanics suggest that both linear impact and rotational acceleration play important roles in the pathophysiology of brain injury. Although nearly every head impact has both a linear component and a rotational component, rotational acceleration is greatest when a tangential blow is sustained. In some cases, the rotational acceleration from such blows can be substantial. For instance, a football player's facemask can act like a lever arm when impacted from the side, and can therefore apply large torsional forces to the head, which can easily result in brain trauma.

Although the conventional wisdom is that the components of modern protective headgear that are designed to attenuate linear impact inherently attenuate rotational acceleration, the reality is that such components are not designed for that purpose and therefore do a relatively poor job of attenuating rotational acceleration. Because of this, new helmet designs have been developed that comprise helmet liners that enable the head to remain more or less stationary while the helmet twists rapidly due to an oblique impact that applies high rotational moments to the helmet. While such helmets are an improvement over traditional helmets, a problem that remains is that most modern chinstraps do not permit much rotation of the helmet relative to the head. Therefore, if new decoupling techniques are to be successfully implemented into the energy absorbing liner, new means for enabling the helmet to rotate relative to the head must be designed into the chinstrap or its attachment to the helmet to enable the jaw to remain relatively stationary while the helmet rotates.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, current chinstraps do not permit much rotation of a protective helmet relative to wearer's head and therefore can limit the effectiveness of helmets that comprise liners that are intended to decouple the head from the violent rotations of the helmet. Disclosed herein are protective helmets that incorporate chinstraps and chinstrap attachment schemes that are configured to enable the helmet to rotate relative to the wearer's head. In some embodiments, the helmet shell can move relative to the chinstrap. In other embodiments, a chin cup of the chinstrap can move relative to one or more bands of the chinstrap.

In the following disclosure, various specific embodiments are described. It is to be understood that those embodiments are example implementations of the disclosed inventions and that alternative embodiments are possible. All such embodiments are intended to fall within the scope of this disclosure.

Described below are protective helmets that not only address linear forces but also tangential forces that cause the highest shear strains on the brain and the brain stem. By optimizing protection from both linear impacts and rotational acceleration, the transmission of shear force to the brain from head impacts can be reduced and so can the incidence of brain injury, such as concussion. The protective helmets can be provided with an energy absorbing inner liner and a chinstrap that together enable the helmet to rotate relative to the wearer's head upon receiving a tangential impact and absorb energy of the impact to reduce rotational acceleration of the head.

Figure 1:
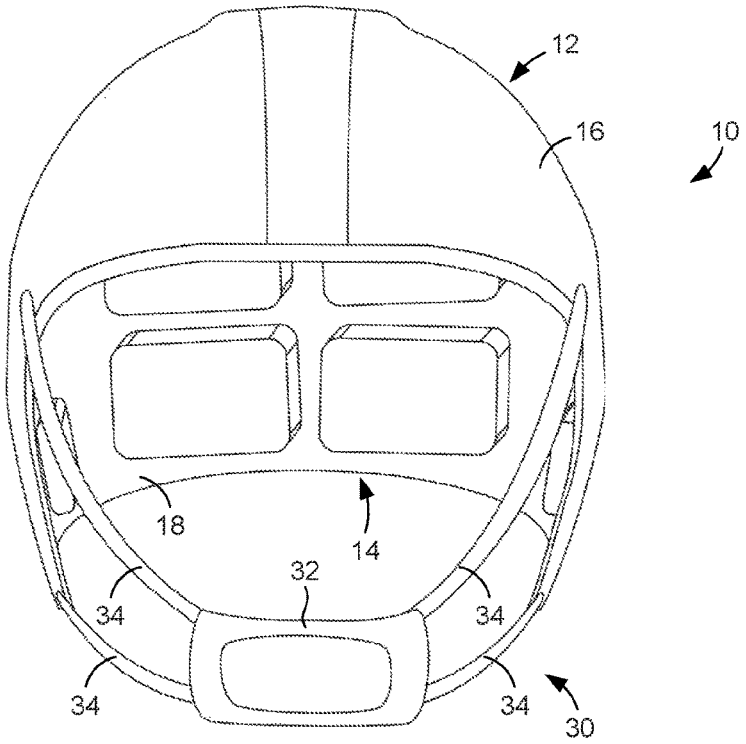
FIG. 1 is a front view of an embodiment of a protective helmet including a chinstrap that enables the helmet to rotate relative to the wearer's chin.

FIG. 1 illustrates an embodiment of a protective helmet 10 that is designed to attenuate both linear impact and rotational accelerations. The helmet 10 shown in FIG. 1 is generally configured as an American football helmet. Although that particular configuration is shown in the figure and other figures of this disclosure, it is to be understood that a football helmet is shown for purposes of example only and is merely representational of an example protective helmet. Therefore, the helmet need not be limited to use in football. Other sports applications include baseball and softball batting helmets, lacrosse helmets, hockey helmets, ski helmets, bicycling and motorcycle helmets, and racecar helmets. Furthermore, the helmet need not even be used in sports. For example, the helmet could be designed as a construction or military helmet. It is also noted that the principles described herein can be extended to protective equipment other than helmets. For example, features described below can be incorporated into protective pads or armor, such as shoulder pads, hip pads, thigh guards, shin guards, cleats, and other protective equipment in which energy absorption could be used to protect the wearer.

With continued reference to FIG. 1, the helmet 10 generally includes an outer shell 12 and an inner liner 14. In the illustrated embodiment, the shell 12 is shaped and configured to surround the wearer's head with the exception of the face. Accordingly, the shell 12, when worn, extends from a point near the base of the wearer's skull to a point near the wearer's brow, and extends from a point near the rear of one side of the wearer's jaw to a point near the rear of the other side of the wearer's jaw. In some embodiments, the shell 12 is unitarily formed from a generally rigid material, such as a polymer or metal material. In some embodiments, the shell 12 is made of a deformable, energy absorbing material. By way of example, the shell 12 can be made of a polyethylene (PE) composition, such as high density polyethylene (HDPE). HDPE is a class of thermoplastic polymers that incorporate long chains of polyethylene mers with molecular weights in the range of approximately 100,000 to 3,000,000. Specific parameters of a suitable HDPE composition include the following:

Tensile Strength to Yield: ~25-31 MPa
Rockwell Hardness (Shore D): ~55-75
Elongation to Break: ~900-1300%
Flexural Modulus: ~1000-1500 MPa
Melt Flow Index: ~5 to 8 g/10 minutes HDPE offers a lower density (0.95 g/cm$^3$) when compared to conventional PC (1.2 g/cm$^3$) or ABS (1.05 g/cm$^3$) formulations. A lower density can be advantageous by providing lower weight to the wearer or a thicker geometry for the same weight. In some embodiments, the shell has a thickness of approximately 2.4 to 4 mm. HDPE also offers a low glass transition temperature of −70° C. to −80° C.

When HPDE is used, the polyethylene of the HPDE can be compounded with one or more additives such as a processing stabilizer that protects the polymer at high temperatures, a heat stabilizer that inhibits degradation of the end product, a slip agent that reduces friction between surfaces (i.e., increases slip), and an ultraviolet stabilizer that inhibits environmental degradation. ADDCOMP ADDVANCE 148 and 796 are two example commercial multifunctional additives that could be used. A range of approximately 1 to 8% by weight of the additives can be compounded with the PE base in the composition.

Irrespective of the material used to construct the shell 12, the shell includes an outer surface 16 and an inner surface 18. In some embodiments, the shell 12 can further include one or more ear openings (not visible) that extend through the shell from the outer surface 16 to the inner surface 18, as well as other openings that serve one or more purposes, such as providing airflow to the wearer's head. A facemask or a face shield (not shown) can be secured to the front of the helmet 10 to protect the face of the wearer.

The inner liner 14 generally comprises one or more pads that sit between the shell 12 and the wearer's head when the helmet 10 is worn. In some embodiments, some or all of these pads comprise an outer energy absorber that is adapted to absorb translational and rotational energy from helmet impacts and an inner cushion that is adapted to provide comfort to the wearer's head. In some embodiments, the energy absorbers include energy absorbing columns that enable the helmet shell 12 to rotate relative to the wearer's head and dissipate translational and rotational accelerations. Example inner liners of the type described above are described in detail in Application Serial Number PCT/US15/60225, which was filed on Nov. 11, 2015 and which is hereby incorporated by reference into the present application in its entirety.

With further reference to FIG. 1, the protective helmet 10 also includes a chinstrap 30 that attaches to the shell 12. Generally speaking, the chinstrap 30 comprises a chin cup 32 that is adapted to contact the wearer's chin and one or more coupling elements 34, such as bands, that couple the chin cup to the helmet shell 12. The chinstrap 30 and/or its attachment to the shell 12 is configured so as to enable the shell 12 to rotate relative to the wearer's head (and chin) to decouple the helmet 10 from the head. Therefore, the head can remain relatively stationary when the shell 12 rotates in response to a significant tangential impart. As described in relation to FIGS. 2-12 that follow, this decoupling can be achieved in a variety of ways. Generally speaking, however, the shell can move relative to the chin cup either because shell can move relative to the chinstrap or because the chin cup can move relative the coupling elements chinstrap.

Figure 2:
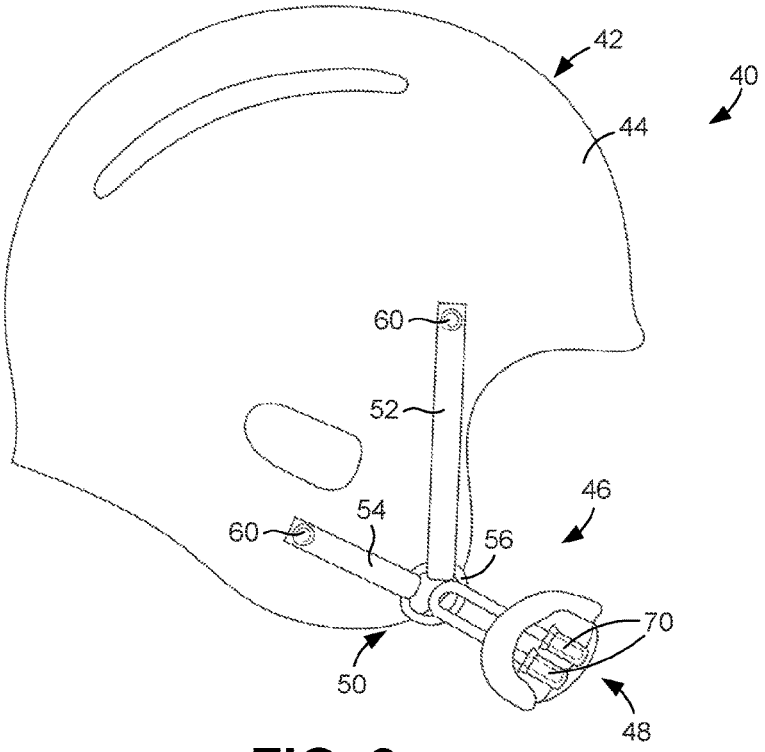
FIG. 2 is a side view of an embodiment of a protective helmet comprising a chin cup that can slide relative to a band of a chinstrap.

FIG. 2 illustrates an embodiment of a protective helmet 40 including an outer shell 42 of the type described above in relation to FIG. 1 having an outer surface 44 and an inner surface (not visible). Attached to the inner surface of the shell 42 is an inner liner (not visible) of the type described above in relation to FIG. 1. Attached to the outer surface 44 of the shell 42 is a chinstrap 46 that generally includes a chin cup 48 adapted to contact and protect the wearer's chin and one or more coupling elements 50 that connect the chin cup to the shell 42. In the illustrated embodiment, the coupling elements 50 comprise a first, generally vertical, upper band 52, a second, generally horizontal, lower band 54, a coupling ring 56, and a chin cup strand 58.

The bands 52, 54 are made of a strong, flexible material, such as a polymer material, and can be generally flat with a rectangular cross-section. The bands 52, 54 are configured to securely attach to the shell 42. To that end, the bands 52, 54 can include fastener elements 60, such as snap fastener elements, that are adapted to connect to mating fastener elements (not visible) that are fixedly mounted to the shell 42. In such a case, the bands 52, 54 can be attached to and detached from the shell 42, as desired. As shown in FIG. 2, the fasteners 60 are located at proximal ends of the bands 52, 54, while the distal ends of the bands are connected to the coupling ring 56.

The chin cup strand 58 is also connected to the coupling ring 56, which serves to connect the bands 52, 54 to the strand. It is noted, however that, in cases in which the strand 58 can be securely connected directly to the bands 52, 54, the coupling ring 56 may be omitted. As illustrated in FIG. 2, the strand 58 can form an endless loop that passes through the coupling ring 58 (on each side of the helmet 10) and through the chin cup 48 twice such that two portions or lengths of the strand pass through the chin cup. In alternative embodiments, the endless loop can be replaced by two separate strands 58 that each passes through the chin cup 48. In still other embodiments, a single strand 58 having free ends that attach to the coupling ring 56 can pass through the chin cup 48. Irrespective of the number or nature of the strand or strands 58, each strand 58 can have a generally circular cross-section that enables the chin cup 48 to slide along the strand when a tangential blow is received by the shell 42.

Figure 3A:
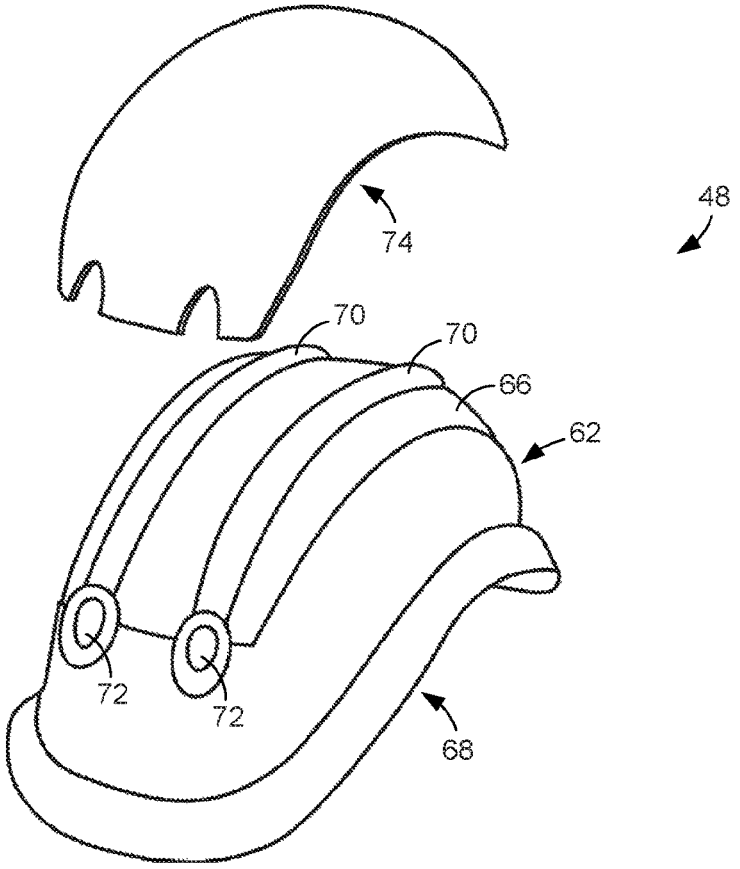
FIG. 3A is a perspective view of the chin cup shown in FIG. 2, the chin cup being depicted in a disassembled state.
Figure 3B:
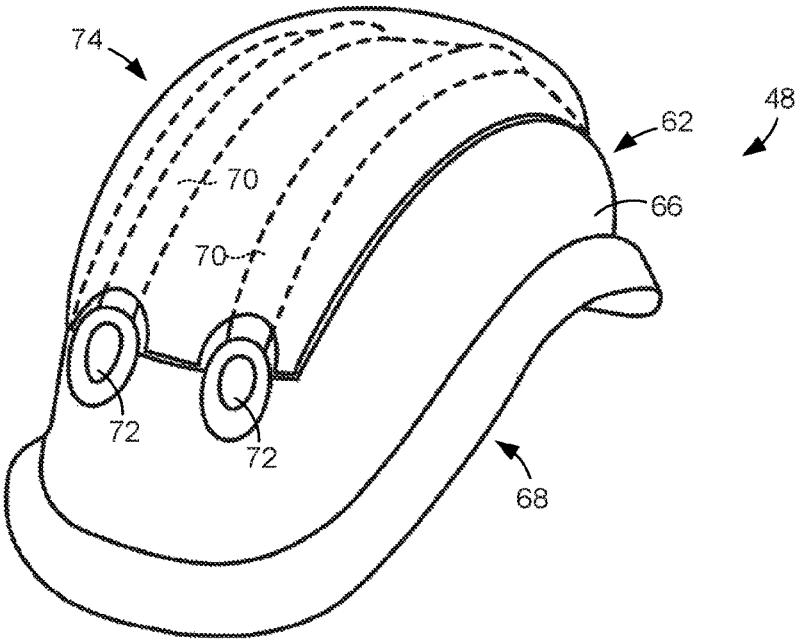
FIG. 3B is a perspective view of the chip cup of FIG. 3A, the chin cup being depicted in an assembled state.
Figure 4:
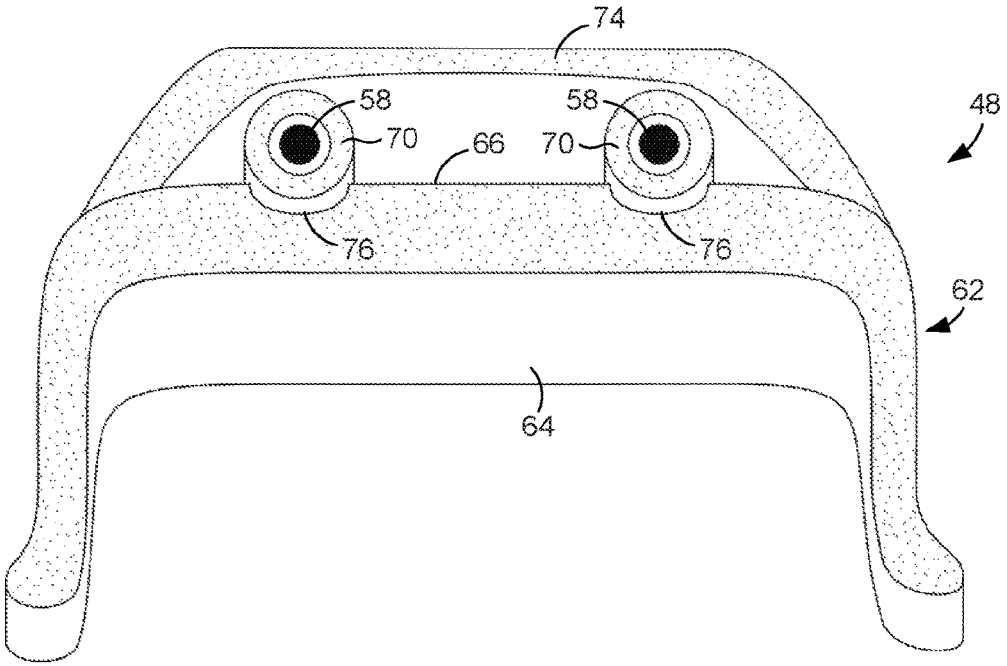
FIG. 4 is a cross-sectional view of the chin cup of FIGS. 3A and 3B.

FIGS. 3-4 illustrate the chin cup 48 in greater detail. Beginning with FIGS. 3A and 3B, the chin cup 48 comprises a cup body 62 that is shaped and configured to receive a wearer's chin. In some embodiments, the body 62 is made of a generally rigid polymeric or metal material such that the body forms a rigid outer shell that provides impact protection to the chin. The body 62 defines an inner surface 64 (FIG. 4) and an outer surface 66, each having a generally rounded cup shape suitable for receiving and protecting the chin. Mounted to the inner surface 64 of the body 62 is padding 68 that, as shown in FIGS. 3A and 3B, can extend to the edges of the body 62. Provided on the outer surface 66 of the body are one or more strand tubes 70 that are adapted to receive the strand or strands 58 of the chin strap 48. In cases in which a single, endless loop strand 58 is used, each tube 70 receives one portion or length of the strand. In cases in which two separate strands 58 are used, each tube 70 receives one of the strands. In cases when a single strand 58 having free ends is used, the chin cup 48 can comprise only one strand tube 70 that receives the strand.

As shown in FIGS. 3A and 3B, the strand tubes 70 each comprise elongated, curved tubes having generally circular cross-sections that follow the curved outer surface 66 of the chin cup 48. The tubes 70 are constructed so as to be robust and to withstand impacts that may be encountered when the helmet 40 is used. In some embodiments, the tubes 70 are made of a metal material, such as aluminum. Aluminum may be desirable because of its high tensile strength. This ensures that the tubes 70 will not be forced out of the proper bend radius during an impact or during rough handling. Steel could also be used to form the tubes 70, as steel has an even higher tensile strength. Copper is also a candidate for construction of the tubes 70 if the tubes are sufficiently thick to resist bending or denting because copper has a very low friction coefficient, which would facilitate sliding of the chin cup 48. With further reference to FIGS. 3A and 3B, the strand tubes 70 each comprise an opening 72 at each end through which a strand 58 can pass. In some embodiments, these openings 72 are outwardly flared to reduce friction and prevent snagging of the strand 58 on the tube openings as the chin cup travels along the strand.

The strand or strands 58 can be made of a strong material that resists gouging and that has a relatively low coefficient of friction. In some embodiments, the strand or strands 58 can comprise a metal cable, such a steel cable. In such as case, the cable can be coated with a low-friction material, such as polytetrafluoroethylene (PTFE) or nylon. Such a coating would not only reduce friction between the strand 58 and the tube 70 but would also reduce wear between these components. In other embodiments, the strand or strands 58 can comprise a polymeric strand, such as a nylon strand. Nylon may be desirable as it has relatively high tensile strength and a relatively low coefficient of friction.

As is further illustrated in FIGS. 3A and 3B, the chin cup 48 can further include an outer panel or cover 74 that cover the strand tubes 70 and provides the cup with a smooth, curved exterior. Like the cup body 62, the cover 74 can have a rounded cup shape and can be made of a rigid material that can withstand impacts to which the chin cup 48 may be exposed. When provided, the cover 74 can, for example, be attached to the cup body 62 by welding, with fasteners (e.g., rivets), or with a snap-fit elements. FIG. 3A shows the cover 74 removed while FIG. 3B and the cross-sectional view of FIG. 4 show the cover attached. FIG. 4 also shows the strand or strands 58 within the strand tubes 70. As is further depicted in this figure, the tubes 70 can be received in grooves 76 formed in the cup body 62.

Figure 5:
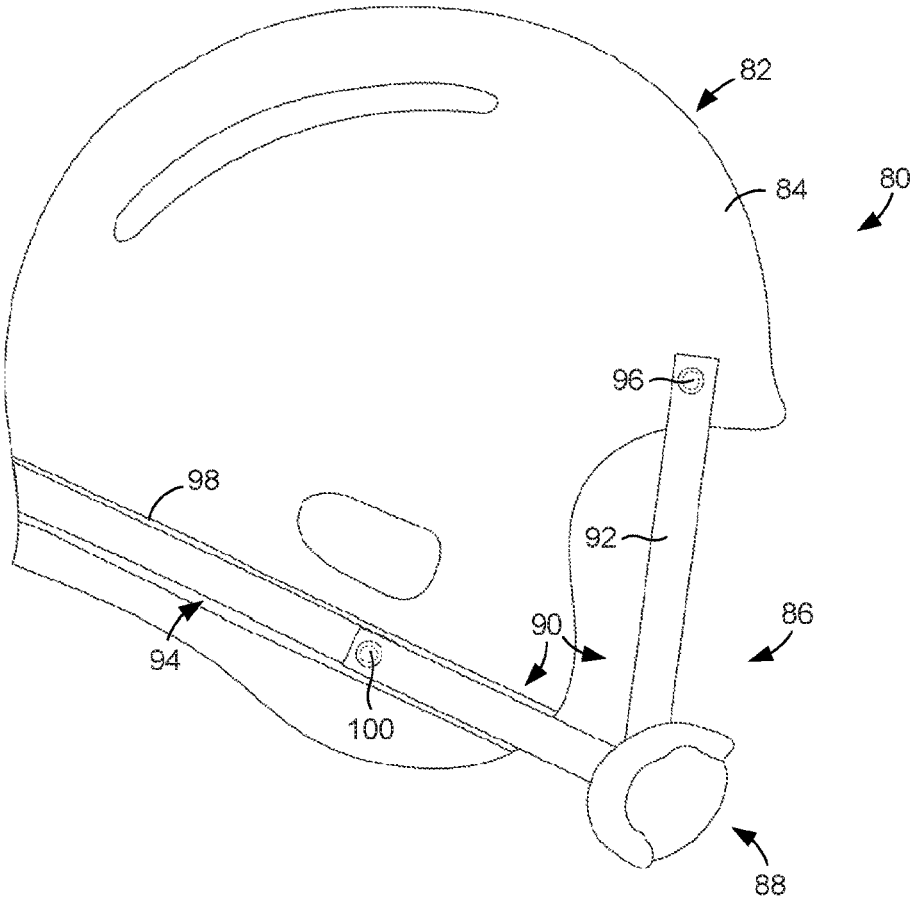
FIG. 5 is a side view of an embodiment of a protective helmet comprising a chinstrap that can slide relative to the helmet.
Figure 6:
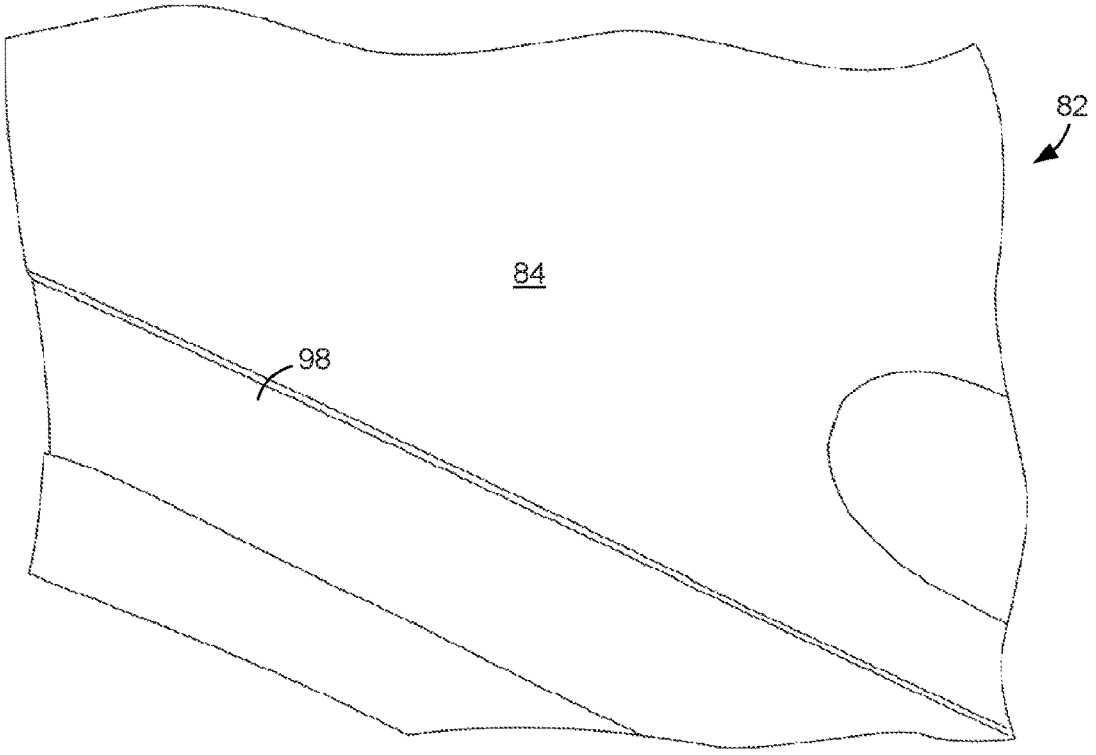
FIG. 6 is a detail view of a first embodiment of a groove formed in the shell of the helmet of FIG. 5.

FIG. 5 illustrates another embodiment of a protective helmet 80 designed to attenuate both linear impact and rotational accelerations. Like the helmet 40, the helmet 80 includes an outer shell 82 having an outer surface 84 and an inner surface (not visible). Attached to the inner surface of the shell 82 is an inner liner (not visible). Attached to the outer surface 84 of the shell 82 is a chinstrap 86 that generally includes a chin cup 88 adapted to contact and protect the wearer's chin and one or more coupling elements 90 that couple the chin cup to the shell 82.

In embodiment of FIG. 5, the coupling elements 90 comprise a first, generally vertical, upper band 92 and a second, generally horizontal, lower band 94. The bands 92, 94 are made of a strong, flexible material, such as a polymer material and can be generally flat with a rectangular cross-section. The upper band 92 is configured to securely attach to the shell 82 at a first, proximal end and to the chin cup 88 at a second, distal end. A fastener element 96 is provided at the proximal end of the upper band 92 to facilitate its attachment to the shell 82. Unlike the upper band 92, the lower band 94 is not securely attached to the shell 82 with a fastener. Instead, the lower band 94 simply wraps around the back of the shell along its base so that one end of the lower band is connected to a first lateral edge of the chin cup 88 and the other end of the lower band is connected to a second lateral edge of the chin cup.

Figure 7:
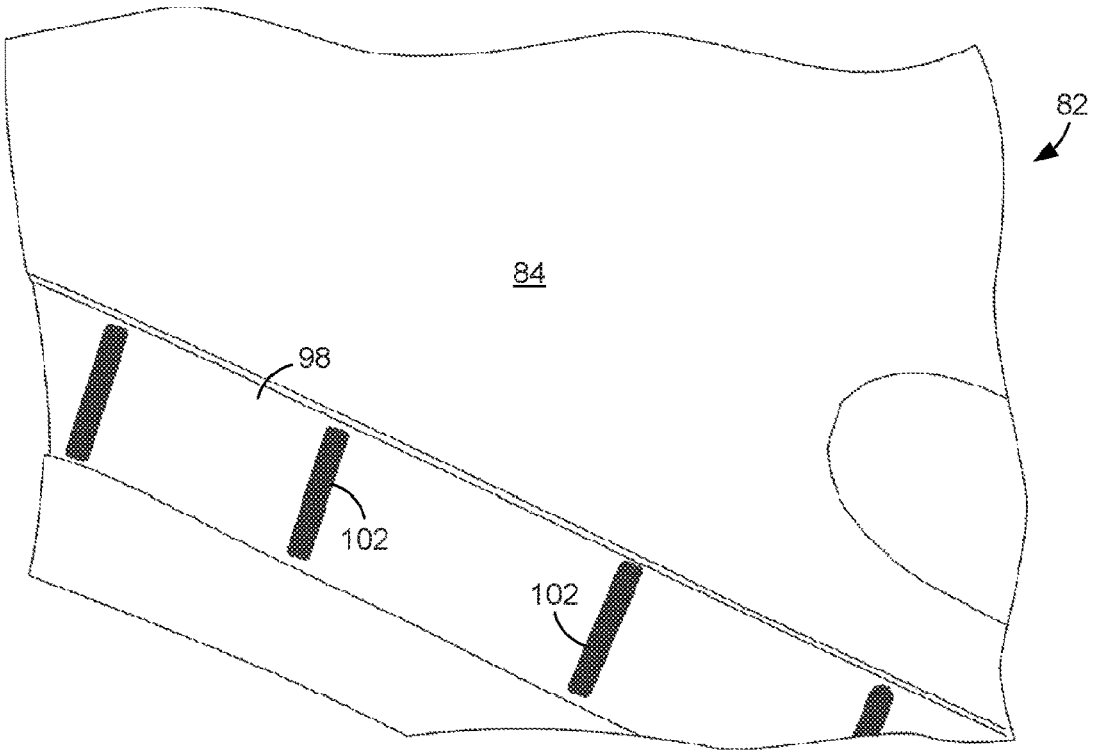
FIG. 7 is a detail view of a second embodiment of a groove formed in the shell of the helmet of FIG. 5.

In some embodiments, the lower band 94 is disposed in a generally horizontal groove 98 (FIG. 6) that likewise surrounds the base of the shell 82. This groove 98 can extend from the front left edge of the shell 82 to the rear of the shell and back to the front right edge of the shell. During use of the helmet 80, the lower band 94 can slide along the groove 98 to enable the shell 82 to rotate relative to the chinstrap 86 and, therefore, the head. In some embodiments, the lower band 94 can comprise a single, continuous band. In other embodiments, the lower band 94 can comprise two or more separate bands that are connected together with one or more fasteners 100 that facilitate removal of the helmet 80. Friction between the lower band 94 and the shell 82 and groove 98 can be reduced to enable the relative motion between the shell and the chinstrap 86. In some embodiments, rollers 102 can be positioned at the bottom of the groove 98 along its length to reduce friction, as shown in FIG. 7.

Figure 8:
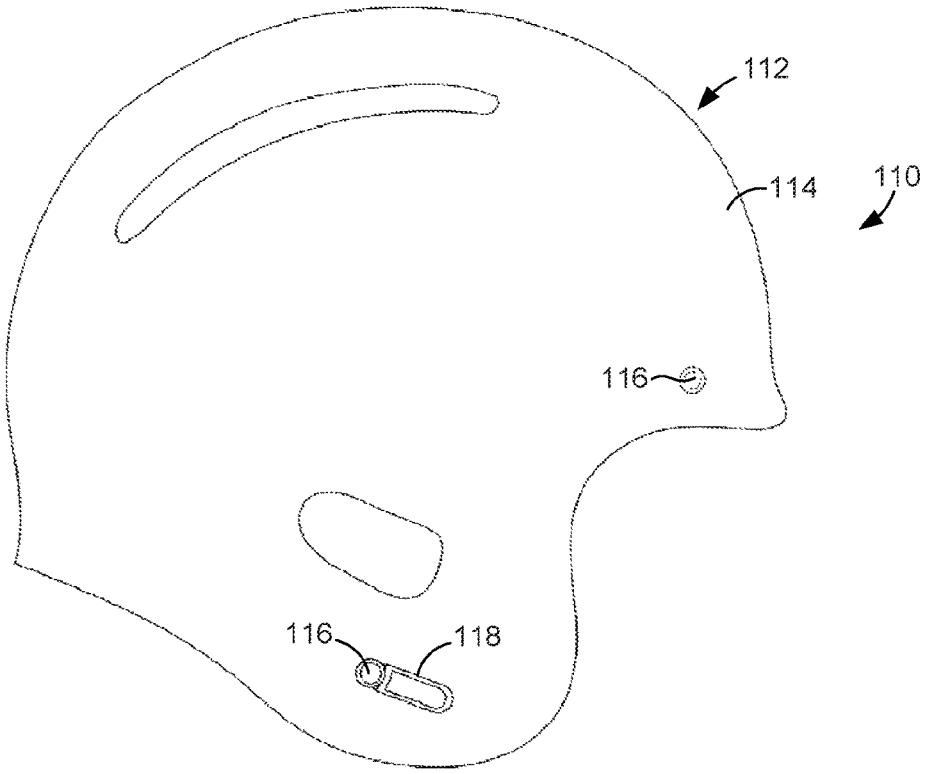
FIG. 8 is a side view of a further embodiment of a protective helmet comprising a chinstrap attachment mechanism that enables the helmet to rotate relative the head.

FIG. 8 illustrates a further embodiment of a protective helmet 110 designed to attenuate both linear impact and rotational accelerations. As before, the helmet 110 includes an outer shell 112 having an outer surface 114 and an inner surface (not visible). Attached to the inner surface of the shell 112 is an inner liner (not visible). A conventional chinstrap (not shown) can connect to the shell 112 with fastener elements 116, such as snap fastener elements. As shown in FIG. 8, one such fastener element 116 is provided within a slot 118 formed in the shell near the base of the shell 112. The slot 118 extends generally horizontally near the base of the shell 112 in a direction along which a generally horizontal, lower band of the chinstrap would extend when attached to the fastener element 116 disposed in the slot.

Figure 9:
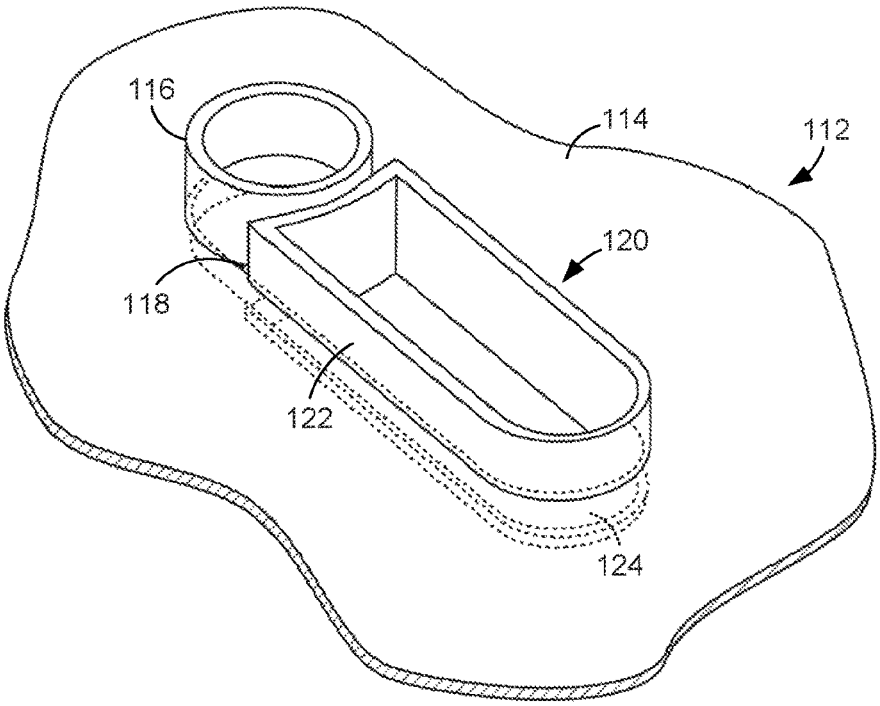
FIG. 9 is a detail perspective view of an embodiment of a chinstrap attachment mechanism that can be used in the helmet of FIG. 8.

FIG. 9 shows a detail view of the fastener element 116 within the slot 118. The fastener element 116 is configured so as to be capable of traveling along the slot 118 without being able to leave it. In some embodiments, this is achieved by providing the fastener element 116 with retaining element, such as a bottom flange (not shown), that retains the element within the slot 118. Also provided in the slot 118 is an obstruction element 120 that occupies part of the slot and therefore impedes the fastener element's travel along the slot. As shown in FIG. 9, the obstruction element 120 can be positioned on the forward end of the slot 118 so as to maintain the fastener element 116 at the rearward end of the slot. In the embodiment of FIG. 9, the obstruction element 120 is a hollow, elongated member that forms a continuous wall 122 that generally follows the inner edges of the slot 118 and the forward side of the fastener element 116. Formed around the outer periphery of the wall is a groove 124 that receives the edges of the slot 120 to provide a means of retaining the obstruction element 120 within the slot. The obstruction element 120 can be made of a polymeric material that has sufficient rigidity to withstand relatively small forces but sufficient flexibility to deform when a relatively large force is applied to it.

During use of the helmet 110, a chinstrap is attached to the shell 112 using the fastener elements 116. A lower band of the chinstrap is attached to the fastener element 116 positioned at the rear end of the slot 118. As the helmet 110 is used, the obstruction element 120 maintains the fastener element 116 in that position. When a tangential impact of substantial force is received and the shell 112 rotates, however, the lower band of the chinstrap will pull the fastener element 116 forward along the slot 118 and deform the obstruction element 120. This deformation enables the shell 112 to rotate relative to the wearer's head. In some cases, the force will be great enough to cause the obstruction element 120 to buckle and be ejected from the slot 118, in which case the fastener element 116 can freely travel along the slot all the way to its forward end.

Figure 10:
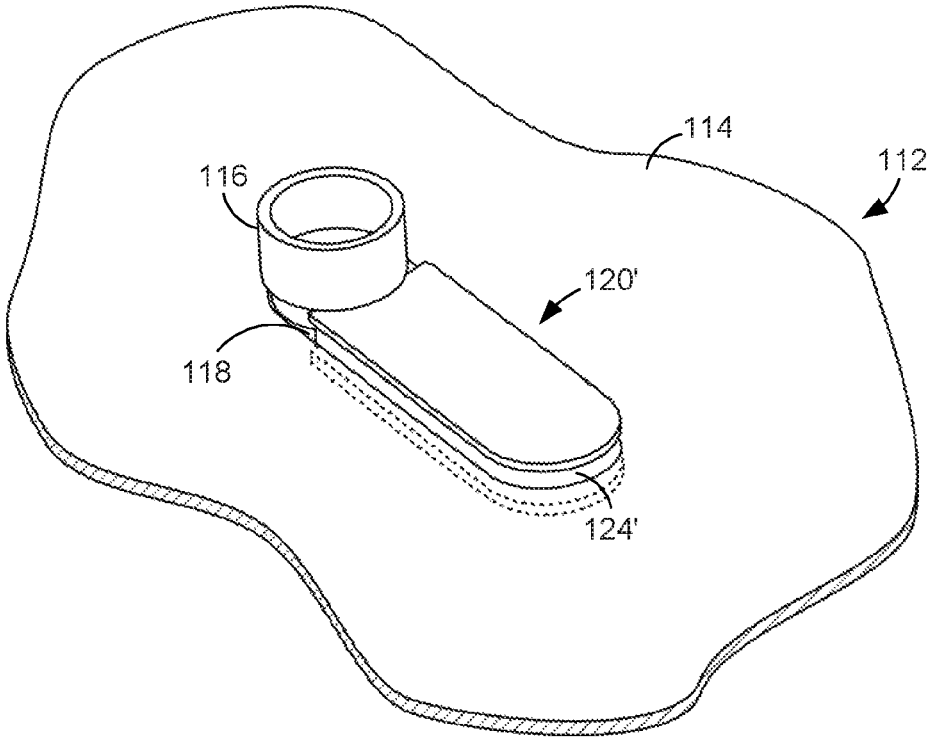
FIG. 10 is a detail perspective view of an alternative embodiment of a chinstrap attachment mechanism that can be used in the helmet of FIG. 8.

FIG. 10 illustrates a variation on the configuration illustrated in FIG. 9. In this case, an obstruction element 120' comprises a resilient member that is adapted to compress when the fastener element 116 is pulled forward along the slot 118 but spring back to its original shape after the forces causing the fastener element's movement have dissipated. The obstruction element 120' can be a solid member made of a resilient material, such as rubber or silicone, and can have a groove 124' formed around its outer periphery that receives the edges of the slot 118 and therefore retains the obstruction element in place within the slot. In some embodiments, the obstruction element 120' can have a variable density so that the density of the obstruction element declines in a direction from the rearward end of the slot 118 toward the forward end of the slot. With such a configuration, the resistance that the obstruction element 120' provides is relatively linear and will not significantly increase as the fastener element 116 traverses the slot 118.

Figure 11:
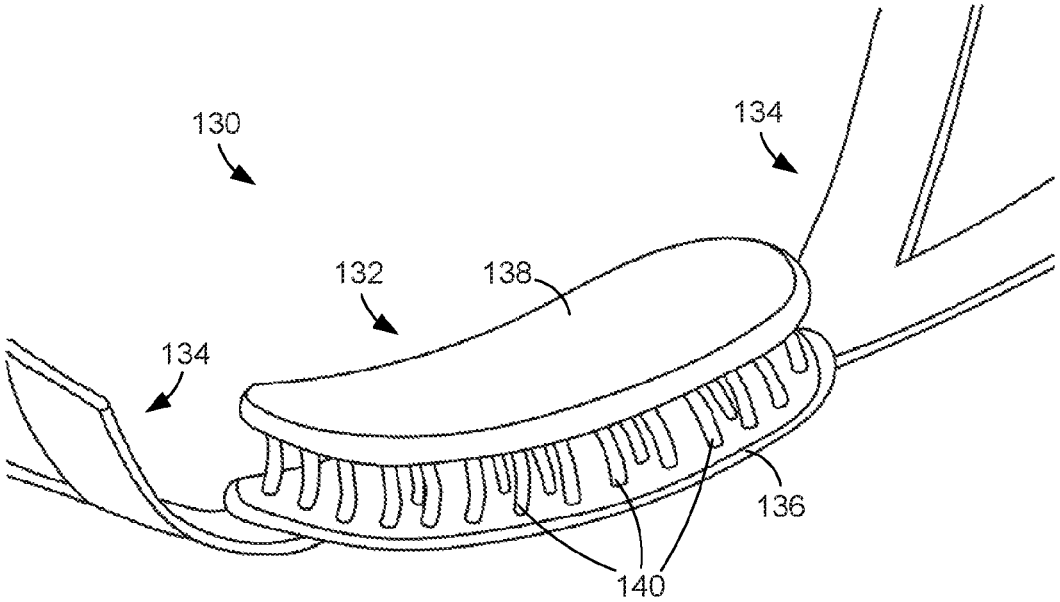
FIG. 11 is a perspective view of an embodiment of a chinstrap comprising a chin cup that incorporates resilient columns that enable relative movement between a helmet and the head.
Figure 12:
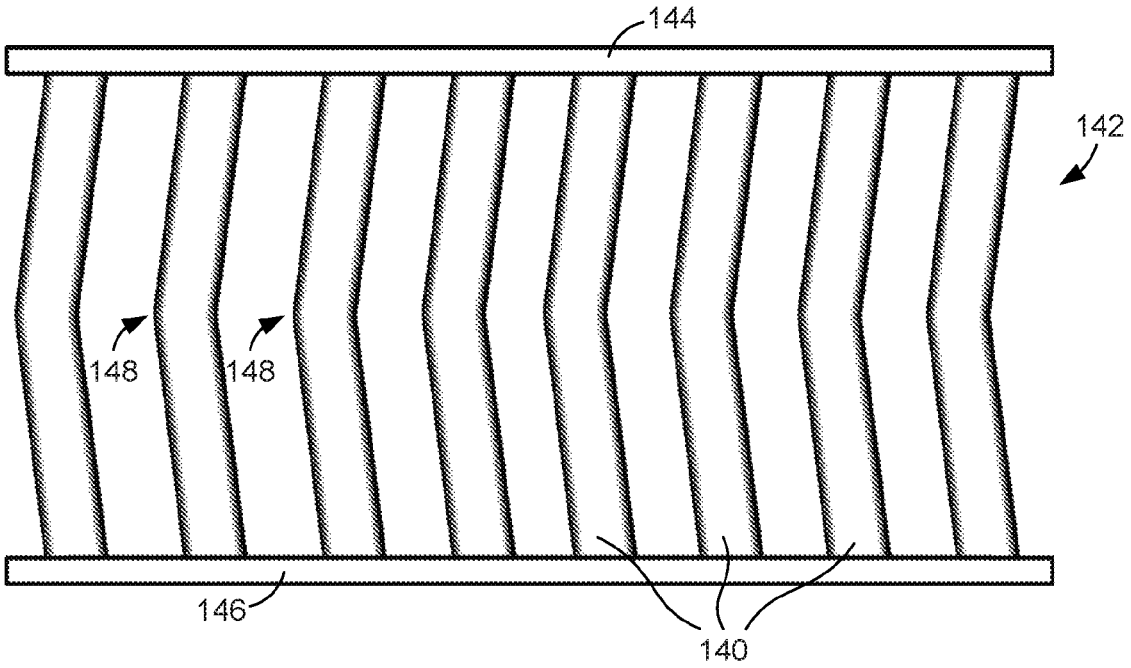
FIG. 12 is a side view of an embodiment of an energy absorber that can be incorporated into the chin cup shown in FIG. 11.

FIGS. 11-12 illustrate a further embodiment of a chinstrap 130 that facilitates decoupling of helmet rotation from the wearer's head. The chinstrap 130 generally comprises a chin cup 132 and coupling elements that comprise bands 134 that can be secured attached to a helmet shell. The chin cup 132 includes an outer member 136 to which the bands 134 are attached and an inner member 138 that is adapted to contact the wearer's chin. The outer and inner members 136, 138 are coupled with an energy absorber that comprises multiple resilient columns 140 that are adapted to bend and buckle when force is applied to the bands 134 to enable the inner member, and therefore the wearer's chin, to move relative to the outer member, and therefore the helmet shell.

FIG. 12 shows an example embodiment for the energy absorber 142 used in the chin cup shown in FIG. 11. As shown in this figure, the energy absorber 142 comprises a first layer of material 144 and an opposed second layer of material 146 between which the columns 140 extend. In some embodiments, each of the first layer 144, second layer 146, and the columns 140 are made of an elastomeric material. In some embodiments, these components are made of a thermoplastic elastomer (TPE), such as thermoplastic polyurethane (TPU). BASF Elastollan 1260D U is one commercial example of a TPU. Other suitable TPEs include copolyamides (TPAs), copolyesters (TPCs), polyolefin elastomers (TPOs), and polystyrene thermoplastic elastomers (TPSs).

As is illustrated most clearly in FIG. 12, the columns 140 can comprise kinks 148 that enable controlled buckling when the columns are compressed. In some embodiments, the columns 140 are preferentially kinked to absorb energy while also maintaining rotational compliance to reduce rotational accelerations on the head. The kinks cause the columns 140 to buckle in a predictable manner while maintaining strength for axial loading.

Figure 13:
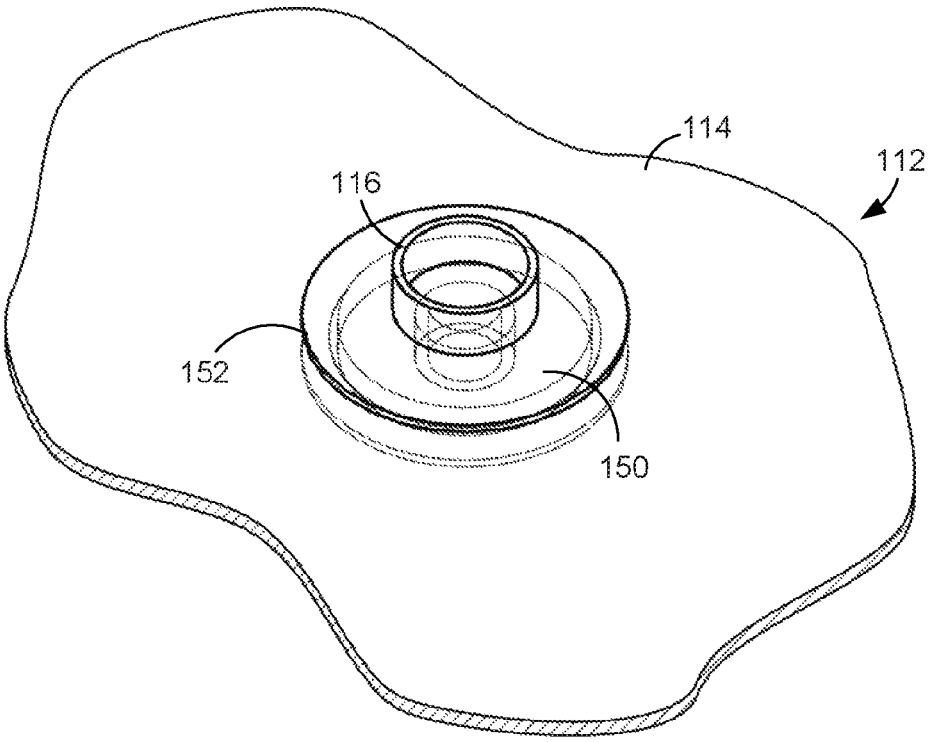
FIG. 13 is a detail perspective view of a further alternative embodiment of a chinstrap attachment mechanism that can be used in the helmet of FIG. 8.

FIG. 13 illustrates a variation on the configuration illustrated in FIG. 10. In this case, a fastener element 116 mounted to a resilient element 150 (an obstruction element) provided within an opening or slot 152 formed in the helmet shell 112. The resilient element 150 can be a solid member made of a resilient material, such as rubber or silicone and can resist movement of the fastener element 116 as it is pulled toward any edge of the opening or slot 152. Like the obstruction element 120' of FIG. 10, the resilient member 150 can spring back to its original shape after the forces causing the fastener element's movement have dissipated.

The invention claimed is:

1. A protective helmet comprising:

an outer shell;

an inner liner provided within the outer shell;

a chinstrap including a chin cup adapted to contact and protect the wearer's chin, a first band, and a second band, the first band extending in a first direction, the first band having a coupling element, the second band extending in a second direction, the second band having a second coupling element, at least a portion of the second band contacting the outer shell; and a decoupling means that decouple the outer shell from the chin cup to enable the shell to rotate relative to the head when the helmet is worn and the chinstrap is securely fastened about the chin.

2. The helmet of claim 1, wherein the decoupling means comprise means for enabling the chin cup to slide relative to the first or second coupling element.

3. The helmet of claim 2, wherein the means for enabling the chin cup to slide comprise a strand chinstrap and a strand tube of the chin cup through which the strand passes.

4. The helmet of claim 3, wherein the strand and the strand tube have generally circular cross-sections.

5. The helmet of claim 4, wherein the strand is a metal cable.

6. The helmet of claim 5, wherein the metal cable is coated with a low-friction material.

7. The helmet of claim 4, wherein the strand is a polymeric strand.

8. The helmet of claim 4, the strand tube is a metal tube.

9. The helmet of claim 8, wherein the tube has outwardly flared openings.

10. The helmet of claim 1, wherein the decoupling means comprise means for enabling the chinstrap to slide relative to the shell.

11. The helmet of claim 10, wherein the means for enabling the chinstrap to slide comprise the first or second band that wraps around the outer shell.

12. The helmet of claim 11, wherein the means for enabling the chinstrap to slide further comprise a groove provided in the outer shell along which the first or second band can slide.

13. The helmet of claim 12, wherein the groove comprises rollers that reduce friction between the groove and the first or second band.

14. The helmet of claim 1, wherein the decoupling means comprise a fastener element to which the first or second band of the chinstrap can be connected, the fastener element being provided in an opening or slot along which the fastener element can travel.

15. The helmet of claim 14, wherein the decoupling means further comprising an obstruction element provided in the opening or slot that impedes the fastener elements travel along the opening or slot.

16. The helmet of claim 15, wherein the obstruction element comprises a polymeric element that is configured to deform and eject from the opening or slot when the fastener element is pulled along the opening or slot in response to a tangential impact being received by the outer shell.

17. The helmet of claim 15, wherein the obstruction element comprises a resilient element that is configured to compress when the fastener element is pulled along the opening or slot in response to a tangential impact being received by the outer shell.

18. The helmet of claim 1, wherein the decoupling means comprise an energy absorber of the chin cup, the energy absorber coupling a first member adapted to contact the chin and a second member attached to the first or second band of the chin strap.

19. The helmet of claim 18, wherein the energy absorber comprises resilient columns that extend between the first and second members.

20. The helmet of claim 19, wherein the columns comprise kinks that enable controlled buckling when the columns are compressed.

21. A protective helmet comprising:

an outer shell;

an inner liner provided within the outer shell;

a chinstrap coupled to the outer shell including a chin cup adapted to contact and protect the wearer's chin; and a decoupling means that decouple the shell from the chin cup to enable the shell to rotate relative to the head when the helmet is worn and the chinstrap is securely fastened about the chin, the decoupling means comprise a fastener element to which a band of the chinstrap can be connected, the fastener element being provided in an opening or slot along which the fastener element can travel.

22. The helmet of claim 21, further comprising an obstruction element provided in the opening or slot that impedes the fastener elements travel along the opening or slot.

23. The helmet of claim 22, wherein the obstruction element comprises a polymeric element that is configured to deform and eject from the opening or slot when the fastener element is pulled along the opening or slot in response to a tangential impact being received by the outer shell.

24. A protective helmet comprising:

an outer shell;

an inner liner provided within the outer shell;

a chinstrap coupled to the outer shell including a chin cup adapted to contact and protect the wearer's chin; and a decoupling means that decouples the outer shell from the chin cup to enable the outer shell to rotate relative to the head when the helmet is worn and the chinstrap is securely fastened about the chin, the decoupling means comprise means for enabling the chinstrap to slide relative to the outer shell, the means for enabling the chinstrap to slide comprises a band that wraps around the outer shell, the means for enabling the chinstrap to slide further comprises a groove provided in the outer shell along which the band can slide, the groove comprises rollers that reduce friction between the groove and the band.

25. A protective helmet of claim 24, wherein the outer shell comprises a deformable, energy absorbing material.

26. A protective helmet of claim 24, wherein the inner liner comprises a plurality of pads, the plurality of pads having an energy absorber.

27. A protective helmet of claim 1, wherein the outer shell comprises a deformable, energy absorbing material.

28. A protective helmet of claim 1, wherein the inner liner comprises a plurality of pads, the plurality of pads comprising an energy absorber, the energy absorber comprises a plurality of energy absorbing columns.

29. The protective helmet of claim 1, wherein the first and second band are the same band or different bands.

* * * * *